United States Patent [19]

Daiguji

[11] Patent Number: 4,612,680

[45] Date of Patent: Sep. 23, 1986

[54] COVER JOINT AND ARMOR FOR BRIDGE CABLE

[75] Inventor: Hisashi Daiguji, Osaka, Japan

[73] Assignee: Harumoto Iron Works Co., Ltd., Osaka, Japan

[21] Appl. No.: 701,911

[22] Filed: Feb. 14, 1985

[30] Foreign Application Priority Data

Mar. 26, 1984 [JP] Japan ..... 59-44559[U]

[51] Int. Cl.[4] ..... E01D 19/10

[52] U.S. Cl. ..... 14/22; 174/92; 24/459; 52/230; 248/74.3

[58] Field of Search ..... 14/22, 23, 21; 248/68.1, 74.1, 74.3; 174/155, 156, 92; 24/459, DIG. 22, 122.6; 52/230

[56] References Cited

U.S. PATENT DOCUMENTS 2,095,721 10/1937 Sunderland ..... 14/22
4,557,007 12/1985 Diaguji et al. ..... 14/22

FOREIGN PATENT DOCUMENTS 1058117 5/1959 Fed. Rep. of Germany ..... 174/156
2303634 7/1973 Fed. Rep. of Germany ..... 248/74.3
55-4167 1/1980 Japan .

*Primary Examiner*—Stephen J. Novosad
*Assistant Examiner*—John F. Letchford
*Attorney, Agent, or Firm*—Wenderoth, Lind & Ponack

[57] ABSTRACT

An armor for a bridge cable including a specified number of trough-shaped metal covers for covering a bridge cable formed of PC steel wire bundles, male and female fitting parts provided on both side edges of the covers for being fitted to each other, and elastic spacers fitted into and connected to the inside of the cover and having concave parts formed thereon for maintaining the PC steel wire bundles in a mass or assembled state. A joint of the cable cover includes a seal member constituted by a specified number of elastic trough-shaped divided bodies for covering the outer periphery of the cable cover by abutting against each other on the side edges thereof, protrusions projecting from the middle of the inside of each divided body for insertion between the facing end edges of the cable covers, and engaging parts projecting from both ends of the outer surface of the divided body. A fixing tube constituted by trough-shaped divided covers, each of which externally contacts with a divided body on the end edges facing the inside of the engaging parts and by fixing parts for fixing the side edges against which the divided cover abuts in a water tight manner.

2 Claims, 10 Drawing Figures

COVER JOINT AND ARMOR FOR BRIDGE CABLE

BACKGROUND OF THE INVENTION

1. Field of the Invention

The present invention relates to a joint of a cover for coating bridge cable, and also to an armor for coating a bridge cable comprising a specified number of bundles of PC steel wires covered, for example, with polyethylene.

2. Description of the Prior Art

For protecting cables used in a bridge, it has been conventional to use methods such as coating of parallel wire strands with a synthetic resin cover, a combination of wrapping of stranded wires of PC steel with a steel tube of synthetic resin tube and injection of an antirust solidifying filler such as cement or the like into internal gaps, and painting with a plated locked coil.

In these methods, however, since the cover or tube is made of synthetic resin, it is deteriorated in a short period of time and as a result the service life is short. Furthermore, it is difficult to insert the stranded wires and a spacer to position the stranded wires into the steel tube or into the synthetic resin tube, and the filler can not be injected smoothly.

In addition, not only the cost is increased by plating and painting, but also the service life is short.

It is one of the objectives of this invention to provide armor cables which are excellent in maintainability and workability.

It is another objective of the invention to solve the above problems by liberating the armor from the influence of the cable, absorbing the dynamic imbalance caused by a difference in physical properties between the steel wire and the armor weight of the, and reducing the armor.

SUMMARY OF THE INVENTION

In order to achieve the aforementioned objectives, the invention provides a joint of a cable cover wherein a seal member is composed of a specified number of elastic trough-shaped divided bodies for covering the outer periphery of a cable cover by abutting against each other on the side edges thereof, protrusions projecting from the middle of the inside of each divided body for insertion between the facing end edges of the cable cover, and engaging parts projecting from both ends of the surface of the divided body. A fixing tube is composed of trough-shaped divided covers, each of which externally contacts with the a divided body on the end edges facing the inside of the engaging parts and fixing parts for fixing the side edges against which the divided cover abuts in a watertight manner. The seal member and the fixing tube are connected with each other so as to be watertight at the facing ends of the cable cover and also to keep the connection parts free from the influence of expansion and shrinkage of the cable cover.

Therefore, in the cable cover joint according to this invention, since the seal member is compressed by fitting the fixing tube to the outside of the seal member, after putting both of the ends of the seal member on the outer periphery of the facing ends of the cable cover, the water-tightness, of the connection parts may be extremely wall maintained, and adverse effects are not exerted on the joint part if the cable cover is elongated by an applied load, or expands or shrinks due to temperature changes.

In addition, a fitting process is easily performed because the seal member is formed in a trough-shaped by the divided bodies which are of a specified number of sections and the fixing tube is also formed in a trough-shape by the divided covers which are of a specified number of divisions.

Furthermore, since protrusions of the divided body are inserted between the end edges of the cable cover, dislocation of the seal member with respect to the cable cover may be prevented, and since the engaging members are provided at both ends of the seal member and both ends of the fixing tube are located adjacent the inside of these engaging members, dislocation of the fixing tube with respect to the seal member may be also prevented.

This invention, moreover, provides an armor for a bridge cable which is intended to prevent the influence of ultraviolet rays, or wind and rain by covering a bridge cable, comprising a specified number of bundles of PC steel wires, with trough-shaped divided covers in a specified number of divisions, and by installing an elastic spacer fitted and assembled inside the cover, which thereby maintains the cable shape, to absorbs the influence of impact and temperature changes, and reduces the weight of the cover.

Therefore, in the armor of a bridge cable according to this invention, since an elastic spacer maintaining the mass shape of the cables is disposed inside the cover, the tendency of the PC steel wires to expand outward from the center is accomodated by the elastic spacer, so that any influence of the cable may not be exerted on the cover. As a result, any excess force does not act on joint between the side edges of the cover, so that a sound joined state may be maintained.

It is also possible to absorb dynamic imbalance (due to expansion, shrinkage, deformation, etc.) caused by a difference is physical properties between the cable and armor. Thus, eventual fracture due to fatigue of the armor may be prevented.

In addition, since the wall thickness is made uniform at both side edges of the cover through use of the spacer, the weight is reduced, and the product may be sold at a lower price. Yet, since the spacer is inserted and fitted into the cover, slip-out of the spacer during service may be prevented.

Moreover, if the cable is loosened, deformation and other effects on the armor may be eliminated by the spacer. The spacer also serves to accomodate differences between the cover and PC steel wire therein.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
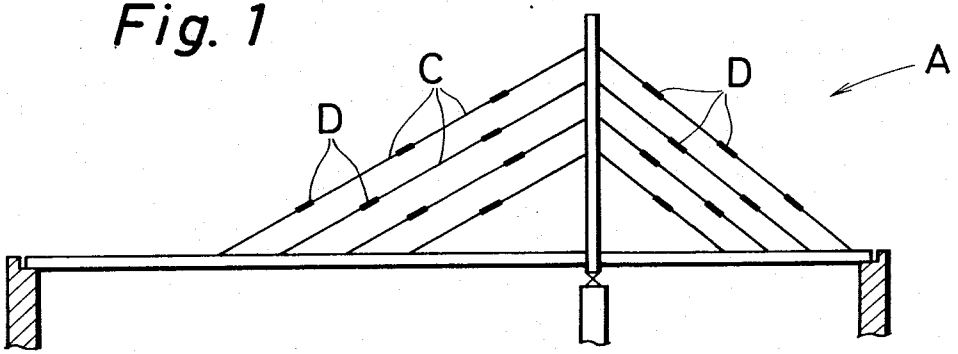
FIG. 1 is a side elevation of an oblique suspension bridge using the joint according to the invention.

Referring now to the drawings, embodiments of the invention are described below.

Figure 2:
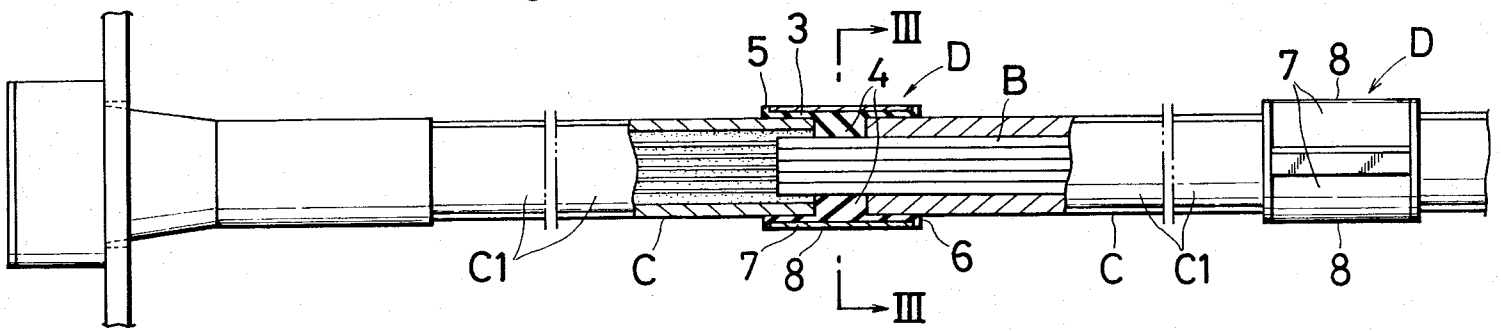
FIG. 2 is a partially cut-away magnified side elevation showing essential parts of FIG. 1.

FIG. 1 is a schematic view showing the joints of the invention being used in cable covers C for protecting cables B (see FIG. 2) in an oblique suspension bridge A, in which the cable covers C may be sequentially mounted on the cables B, or, as shown in FIG. 2, mounted thereon by dividing a tube body into two or more sections to form a trough-shaped covers C1 which may be fitted on the outer periphery of the cables B, and by thereafter fixing the fitted or abutted side edges of these divided covers C1 in watertight state by field welding or mechanical joining or by other methods.

Figure 8:
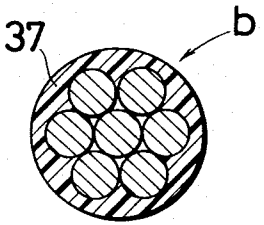
FIG. 8 is a longitudinal magnified side elevation of an unbonded type of PC steel wire.

The cable may be either an assembled group of a specified number of bundles of PC steel wires, or, as shown in FIG. 8, an unbonded type of PC steel stranded wires with a polyethylene sheath.

Reference mark D denotes the joint to link the facing ends of the cable cover C.

Figure 3:
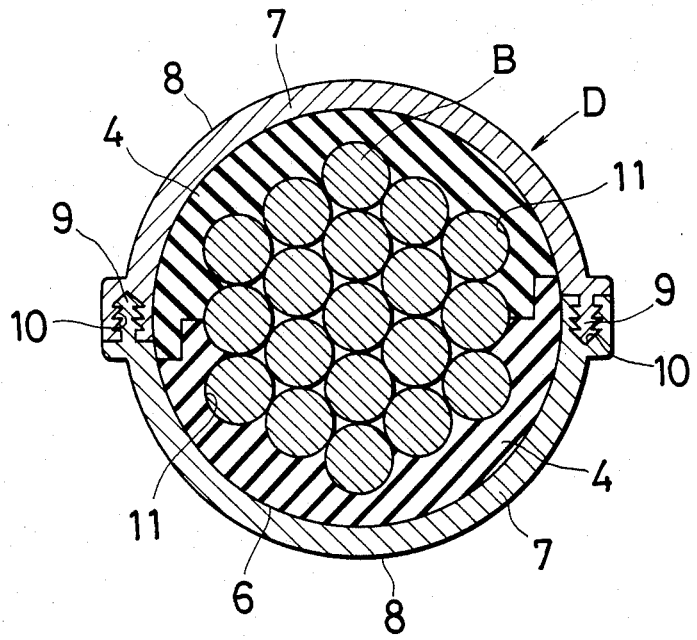
FIG. 3 is a longitudinal sectional view of FIG. 2 observed from the line III—III.
Figure 4:
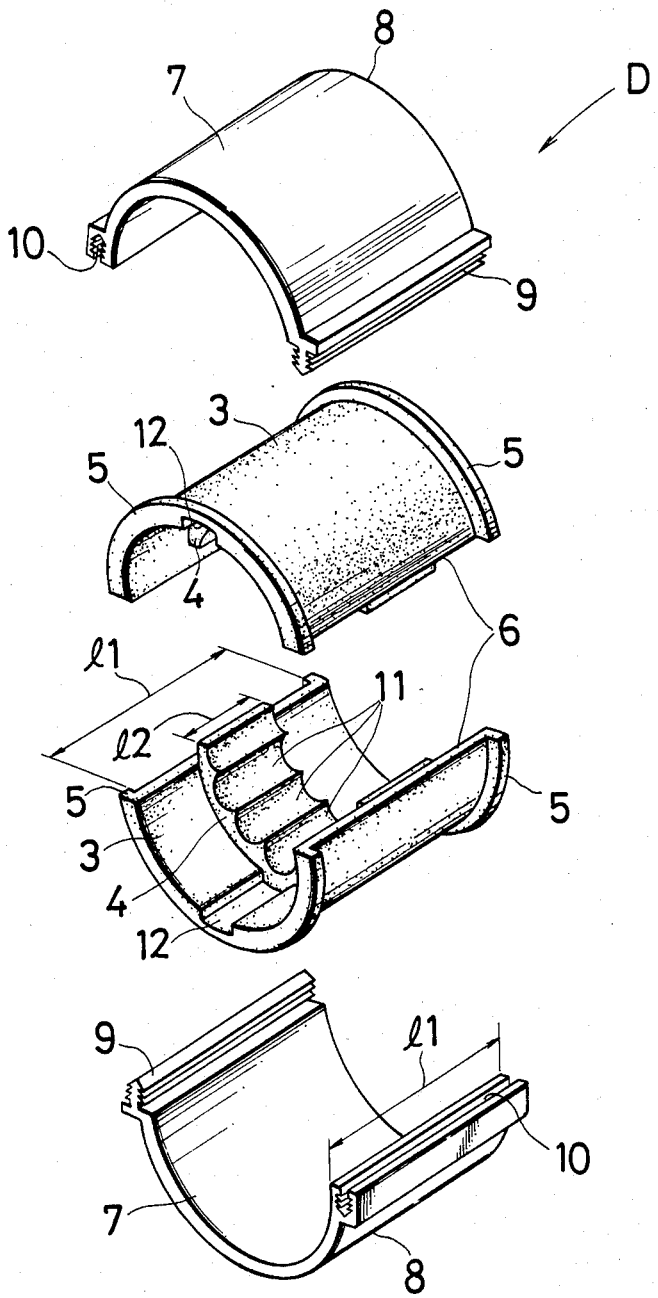
FIG. 4 is an exploded perspective view of FIG. 3.

The joint D is composed of, as shown in FIGS. 2 through 4, the combination of a seal member 6, which comprises divided bodies 3 made of an elastic tube body such as rubber which is divided into two or more semi-annular sections, in the circumferential direction and along the axial direction, which externally contact with the outer peripheries of adjoining cable covers C at both ends thereof, protrusions 4 provided centrally of both ends on the inside of each divided body 3 so as to fit between facing ends of the cable covers C, and engaging parts 5, such as semi-annular flanges projecting radially outwardly from both end edges of the surface of each divided body 3; and a fixing tube 8, which comprises trough-shaped divided covers 7 each externally contacting with the divided body 3 with the end edges facing the inside of the engaging parts 5, and fixing parts 9, 10 for fixing the abutted side edges of each divided cover 7 so as to keep the joint watertight.

In the above illustrated example, the fixing parts are inserted and joined to provide a watertight joint by forming sawtooth protrusions 9 and grooves 10 on opposite sides of each divided cover 7. The fixing parts of adjoining covers may be engaged with each other, or they may also be fixed by other methods, such as those used in joining the cable cover C.

Meanwhile, as shown in the figures, by providing the protrusions 4 with recesses 11 in which each bundle of PC steel wires of cable B fit, the bundled state of the PC steel wires may be maintained, and also the protrusions 4 may be tightly fitted to the outer periphery of the cable B. Reference numeral 12 in FIG. 4 is a groove provided inside the divided body 3 for the side edge fixing parts of divided covers C1, C1 to fit therein.

The joint of the cable cover in this invention is thus composed, and the method of using this joint D is described below.

At the erection site of the oblique suspension bridge, the cable B is covered by the cable cover C. At this time, an interval equal to a width $l_2$ of the protrusion 4 is set between the facing edges of the cable covers C, C arranged in series. Then, while fitting the protrusions 4 of the seal member 6 between the facing ends of the cable covers C, C, both the ends of each divided body 3 are externally fitted to the cable covers C. At that time, the side edges of each divided body 3 are abutted against each other. Next, each divided cover 7 of the fixing tube 8 is fitted into the outside of the seal member 6 over a length of $l_1$, and also the abutted side edges of the divided cover 7 are fixed to maintain a watertight joint.

Consequently, since the seal member 6 is compressed to cause the divided body 3 to be urged against the cable cover C and to cause abutted side edges of the divided body 3 to press against each other, entry of rain water into the space between the seal member 6 and cable cover C may be prevented.

Figure 5:
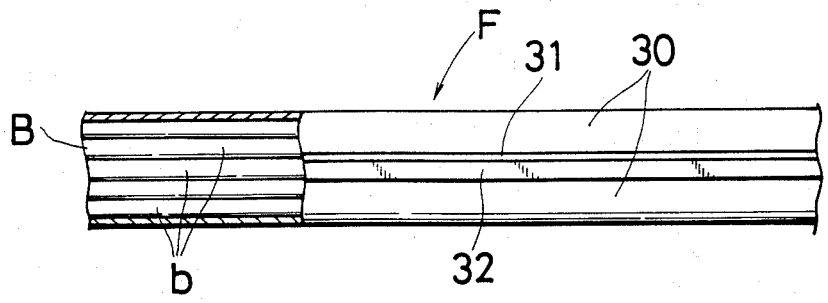
FIG. 5 is a partially cut-away magnified side elevation showing a unit protective armor of the oblique suspension bridge.
Figure 6:
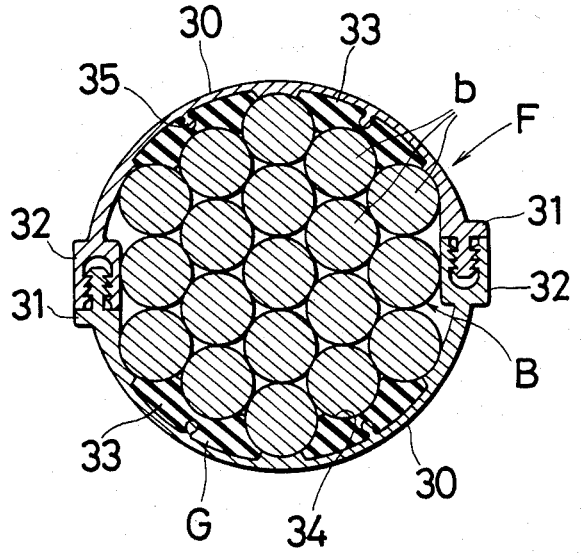
FIG. 6 is a longitudinal magnified front view of FIG. 5.

In another embodiment of this invention, as shown in FIGS. 5 and 6, a unit protective armor F for a cable B, which is assembled with a specified number of PC steel wires b in parallel arrangement, is composed of two or more trough-shaped covers 30, and a male fitting part 31 and a female fitting part 32 is provided on both side edges of each cover 30 to be coupled by insertion with corresponding fitting parts on other covers.

Figure 7:
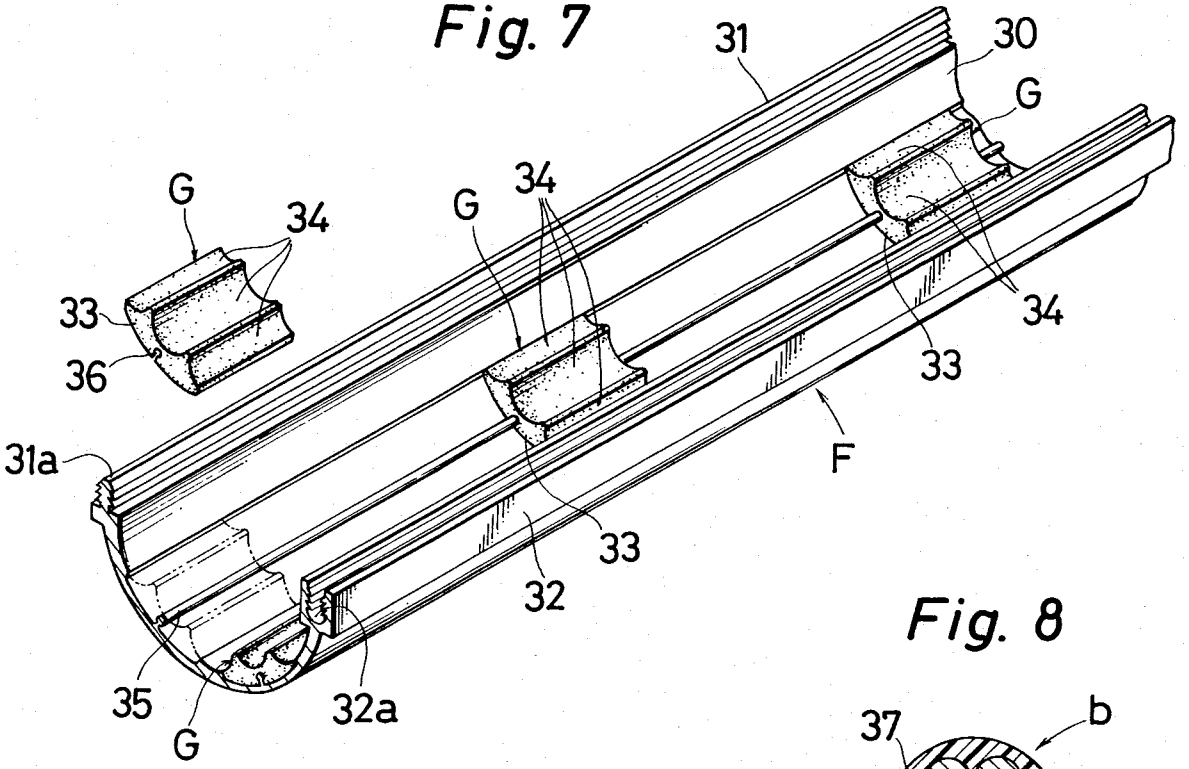
FIG. 7 is a perspective view of an armor of the invention.

The male fitting parts 31 and female fitting parts 32 are, as shown in FIG. 7, composed of protrusions which are pushed into grooves 32*a*, and are intended to maintain a coupled state without allowing disengagement by causing the sawtooth concave and convex parts provided at both sides of the grooves 32*a* and protrusions 31*a* to mesh with each other.

Elastic spacers G are provided inside the cover 30 which fit into and are connected to the cover 30 for maintaining the assembled form of the cable B. Each spacer G is composed of an elastic plate 33 made of rubber or other soft synthetic resin, with parallel grooves 34 provided for part of the outer periphery of the PC steel wires b to fit into the surface of the elastic plate 33. The spacers G are disposed sporadically inside the cover 30 as shown in FIG. 7, but a spacer G may also be provided for the entire length of the cover 30.

The spacers G are fitted in the cover 30, in the illustrated example, by means of parallel protrusions 35 having bulbous parts at the front end edges thereof, the protrusions 35 being integrally provided in the axial direction inside the cover 30. Grooves 36, in which the protrusions 35 fit, are provided in the spacers G, the grooves 36 being expanded by bending the spacers G to fit the grooves 36 to the protrusions 35 followed by unbending of the spacers G. In another embodiment, to obtain the same effect, grooves are provided in the spacer 30 and protrusions are formed on the spacer G which are arranged to be fitted together.

Incidentally, the cover 30 is made of an extruded form of aluminum, which is cut to a specified length for use. As PC steel wires b, meanwhile, those of the unbonded type with a polyethylene sheath 37 as shown in FIG. 8 are used.

The armor of a bridge cable according to this invention is thus composed, and the method of protection of cable by using this armor F is described below.

Namely, at the erection site of the oblique suspension bridge, a specified number of PC steel wires b having a specified length are arranged in parallel to form a cable B, and the terminal ends of the cable B are fixed by a known method.

Then a pair of covers 30, 30 are fitted to the outer periphery of the cable B, and the male fitting parts 31 and female fitting parts 32 of the covers 30, 30 are fitted together. At this time, part of the circumference of each of the PC steel wires b positioned on the outer periphery of the cable B is fitted into one of the grooves 34 of the spacer G, disposed inside both the covers 30, 30.

Thus, the cable B is covered with the armor F for its overall length, and the abutting ends of the armor F are connected by using a proper joint. However, in locations easily subjected to impacts from outside, longer spacers G or a greater number of spacers G are used.

Figure 9:
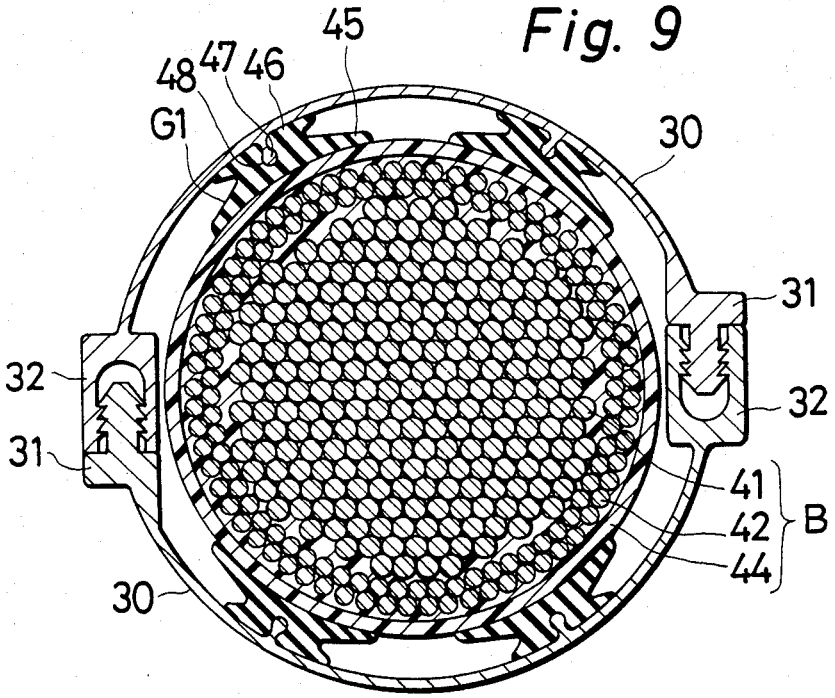
FIG. 9 is a sectional view at a right angle to the axis of another embodiment of this invention.

FIG. 9 is a sectional view of another further another embodiment of this invention, in which the same reference marks are given to parts corresponding to those used in the foregoing embodiment of FIG. 6. Wire bundles 41 of PC steel wires are wound with and tightened by a spiral wire rope 42 made of PC steel wires which are grouted and inserted into a tube body 44 made of polyethylene or other synthetic resin material, thus composing a cable B. A cable B of this type has already been utilized in the oblique suspension bridge under construction or already in use, and in order to protect this cable B or for the purpose of beautification of appearance, the cable B is covered with a cover 30 surrounding an elastic spacer G1 in accordance with the invention. The elastic spacer G1 is made of rubber or soft synthetic resin, and comprises a support part 45 which adheres to the outer periphery of a tube body 44 and another support part 46 which abuts against the inner periphery of the cover 30. The cover 30 has a protrusion 47 extending in its axial direction, and a groove 48, formed in the support part 46, fits with this protrusion 47. A plurality of the protrusions 47 and spacers G1 are provided in the circumferential direction of the covers 30 (four for each, in this embodiment). The spacers G1 may be sporadically disposed in the axial direction of the cover 30, or they may extend continuously in the axial direction. The remaining structure of the cover 30 is the same as in the foregoing embodiment.

Figure 10:
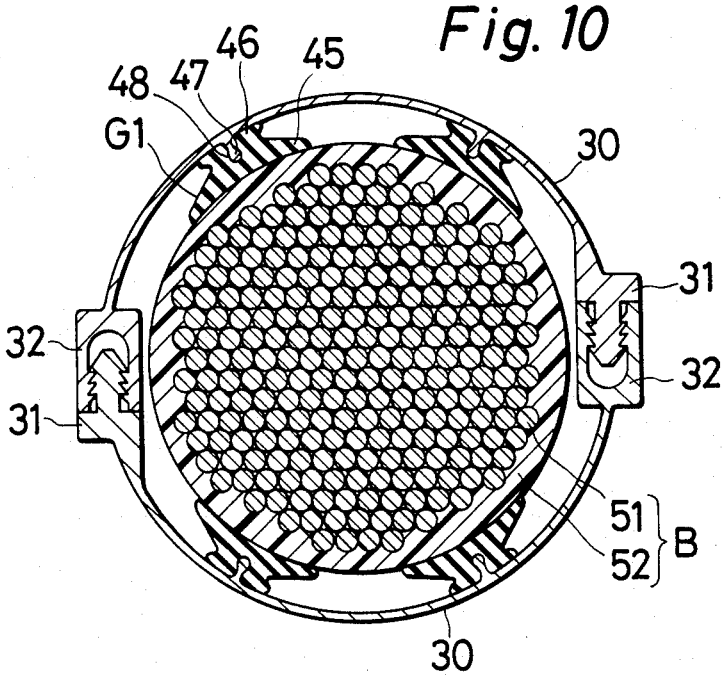
FIG. 10 is a sectional view at a right angle to the axis of a further embodiment.

FIG. 10 is a sectional view of still another embodiment of this invention, which is similar to the embodiment disclosed in FIG. 9, wherein the same reference marks are given to corresponding parts. The cable B in the oblique suspension bridge under construction or already in use is composed of wire bundles 51 and a tube body 52 made of a synthetic resin material such as polyethylene externally surrounding them. Such a cable B is also covered with the cover 30 by way of spacers G1, so that not only is the cable B protected but the appearance is enhanced.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An armor for a bridge cable comprising:

a plurality of trough-shaped covers, each of which has a first side edge and a second side edge which extend in a longitudinal direction, said covers having inner surfaces for covering a bridge cable formed of bundles of PC steel wires;

each of said covers having a male fitting part provided on said first side edge and a female fitting part provided on said second side edge, said male fitting part of one of said covers and said female fitting part of another of said covers being fitted together for covering a bridge cable;

protrusions formed on said inner surfaces of said covers, each of said protrusions extending in said longitudinal direction;

at least one elastic spacer having grooves on an inner surface thereof for maintaining the bundles of PC steel wires in a mass shape, said elastic spacer having a groove on an outer surface thereof which extends in said longitudinal direction and is adapted to receive one of said protrusions formed on said inner surfaces of said covers.

2. The armor of claim 1, wherein a plurality of elastic spacers are provided at intervals circumferentially around said inner surfaces of said covers and a plurality of elastic spacers are provided at intervals along said longitudinal direction on said inner surfaces of said covers.

* * * * *